United States Patent [19]

Singleton

[11] 3,944,189

[45] Mar. 16, 1976

[54] DOOR OPENING AND CLOSING APPARATUS FOR TUMBLING BARREL

[76] Inventor: Albert Singleton, 7360 Brookside Park, Middleburg Heights, Ohio 44130

[22] Filed: June 24, 1974

[21] Appl. No.: 482,743

Related U.S. Application Data

[63] Continuation-in-part of Ser. No. 419,815, Nov. 28, 1973, Pat. No. 3,861,654.

[52] U.S. Cl. ..... 259/89; 49/41; 204/213; 220/252

[51] Int. Cl.[2] ..... B01F 9/02

[58] Field of Search ..... 259/89, 90; 49/40, 41; 220/41; 204/213, 214

[56] References Cited

UNITED STATES PATENTS 3,283,944 11/1966 Richardson ..... 220/41

*Primary Examiner*—Harvey C. Hornsby
*Attorney, Agent, or Firm*—Fay & Sharpe

[57] ABSTRACT

A rotatable barrel for the surface treatment of particulate matter enclosed therein including a generally round perforated barrel with end elements. An opening is provided in the side for the insertion and discharge of particulate matter and a door for opening and closing said opening is mounted on lever arms to swing in an arc between open and closed positions. The lever arms are mounted on hubs extending from the ends of the barrel along its axis of rotation and are mechanically, rigidly attached to gears spaced from the ends of the barrel. A limitation is placed on the arc through which the door may swing relative to the barrel; stop means are provided both adjacent one edge of the opening and remote from the other edge of the opening whereby the door may swing into closed position in abutment with the one stop means adjacent the opening and may swing completely out of the opening into engagement with the other stop means. The door serves as the driving mechanism for turning the barrel in response to the direction of gear rotation.

11 Claims, 12 Drawing Figures

DOOR OPENING AND CLOSING APPARATUS FOR TUMBLING BARREL

BACKGROUND AND BRIEF DESCRIPTION OF THE INVENTION

This is a continuation-in-part of application Ser. No. 419,815, filed Nov. 28, 1973, entitled DOOR OPENING AND CLOSING APPARATUS FOR TUMBLING BARREL, now U.S. Pat. No. 3,861,654.

The barrel of this invention is generally related to cleaning, rinsing, degreasing, pickling, phosphating, black oxidizing, oil drippings, etc. and as a general rule these are stainless steel type barrels. Commonly the barrels are constructed of "Carpenter Stainless Steel".

Over the years many, many designs for door opening and closing structure has been suggested, all intended to accomplish (1) a tight door closing which will prevent the loss of the particulate matter from the barrel as it rotates within the tank of treating fluid and (2) a quick opening door to allow for the fast dumping and refilling of the barrel. The need has always been for some automatic mechanism whereby no manual work is necessary to open and close the door. This invention accomplishes that purpose.

The invention herein is not difficult or complicated after it is explained. However, this is true with many inventions and the solution may seem quite easy and clear once the inventor has conceived of the solution. Hence, it should be recognized that this problem has been before the industry for a century or more without the solution disclosed herein.

The structure includes a conventional drum having flat end-walls and a circular side-wall. An L-shaped channel is welded longitudinally along the barrel periphery. Said channel lies along one side of an opening through the side-wall while another parallel L-shaped channel is welded longitudinally along the barrel but, remote from the opposite side of the opening. A door is mounted on lever arms extending from the hubs at the axis of rotation of the barrel and the door is allowed to swing in an arc between the two L-shaped channels or stop means. At one extreme, the opening is unobstructed and particulate matter may be dumped into the barrel through the unobstructed opening. At the other extreme, the door blocks the opening and prevents particulate matter from entering or leaving the barrel.

Mechanically connected to each of the lever arms is a gear at each end of the barrel. As the gear is driven in one direction, it drives the door to the appropriate L-shaped channel and thereafter, the door serves to drive the drum in its rotation. Rotation in one direction closes the door and tumbles the particulate matter within the barrel. Rotation in the opposite direction turns the barrel until the opening is on the down side and the particulate matter drops out of the barrel by gravity.

DESCRIPTION OF THE PREFERRED EMBODIMENT

Figure 1:
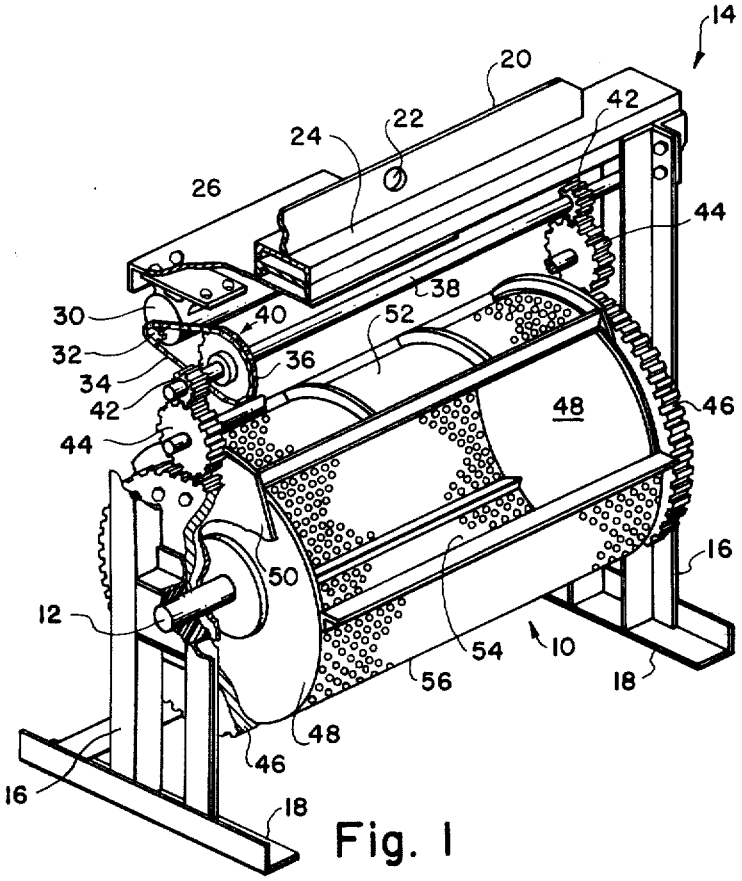
FIG. 1 is a perspective view, partially in section, illustrating the barrel mounting frame and drive mechanism of this invention.
Figure 2:
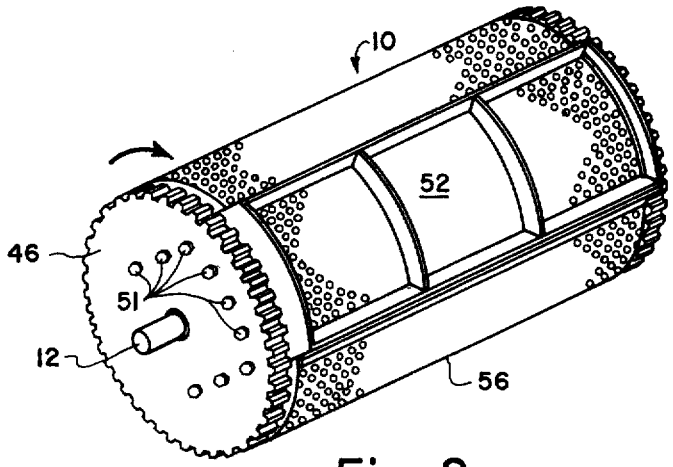
FIG. 2 is a perspective view of the barrel of FIG. 1 alone and showing the door in closed position.
Figure 3:
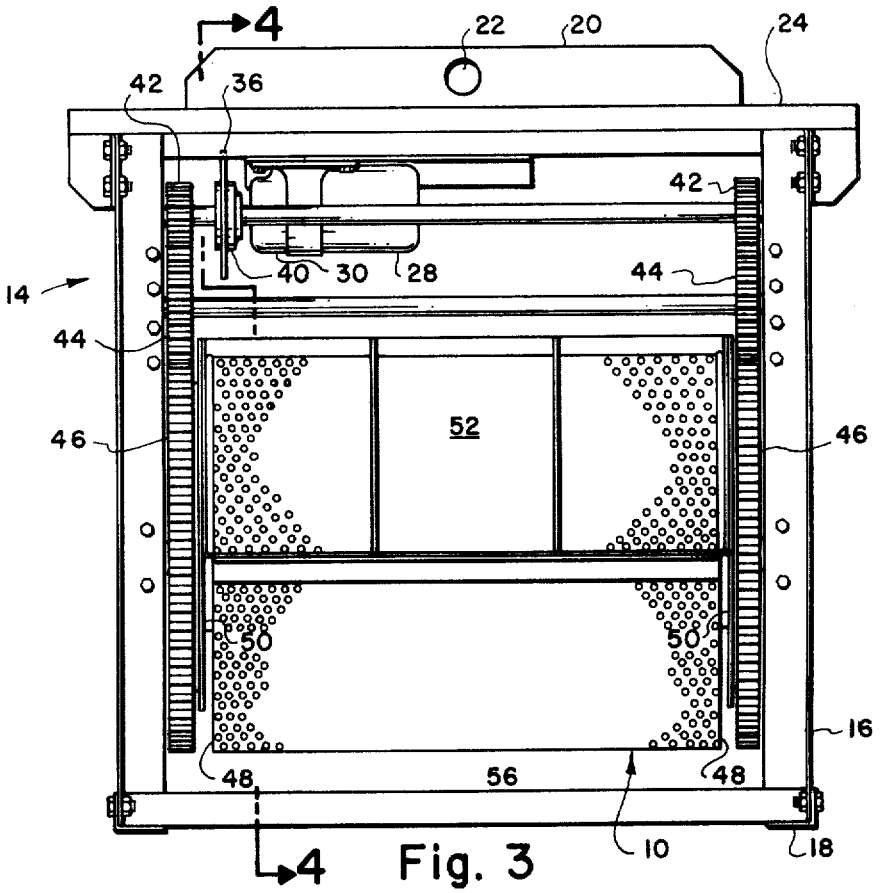
FIG. 3 is a side elevational view of the apparatus of FIG. 1.
Figure 4:
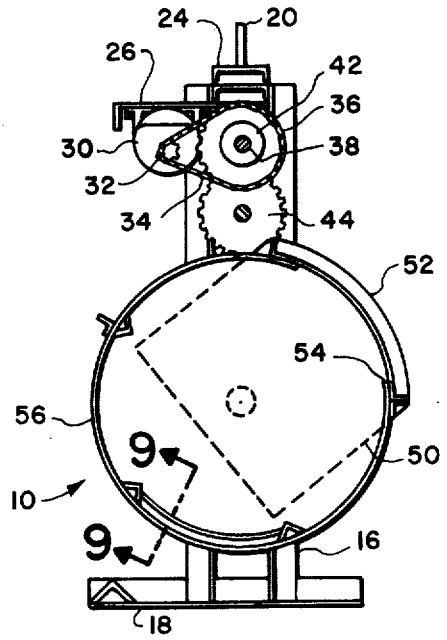
FIG. 4 is a sectional view taken along line 4—4 of FIG. 3.

Observing FIG. 1, a foraminous or porous barrel 10 is mounted for rotation on hubs 12 in a frame 14. The frame includes downwardly extending legs 16 with foot portions 18 which serve to mount the barrel 10 above some substrate and will serve to stabilize the positioning of the drum as it rotates within the treating fluid in a tank or when the drum is to be placed on a substrate and the drum rotated to dump the particulate material after it has been treated. Mounting the drum well above the substrate allows any particulate material to fall out of the drum without obstructing the rotation thereof.

A conventional lifting mechanism is illustrated comprising a plate 20 with an aperture 22. Said plate being mounted on a U-shaped channel 24. In the preferred embodiment dual channels 24 are welded together but, it is clear that one such channel could serve the purpose under certain circumstances.

Mounted beneath the U-shaped channel 24 is a splash plate 26 which serves to protect a motor 28. Preferably the motor 28 is run electrically and the splash plate 26 serves the purpose of preventing any fluids dropping from above from contacting the electric motor 28 and shorting the same. In plants using automatically controlled barrel transfer apparatus involving a plurality of the barrels such as are illustrated herein, barrels being conveyed are dripping treating fluid when they pass overhead when they are transferred from one treating tank to the next. The splash plate 26 prevents such dripping fluid from contacting the motor 28.

Mounted coaxially with the motor 28 is a gear reducer 30 having a sprocket 32 attached to its outlet end and driving a chain 34 over a second sprocket 36 mounted on drive shaft 38.

As a safety feature, the sprocket 36 is connected to the shaft 38 through a friction clutch 40 to prevent damage to the motor through overload.

A drive gear 42 is mounted on each end of the shaft 38 to drive an idler gear 44, which in turn drives an end gear 46, one end gear being mounted coaxially with the hubs 12 at each end of the barrel 10.

Illustrated in U.S. Pat. No. 3,668,103, owned by the inventor, is an alternative drive motor arrangement which could be applied to this invention without departing from the inventive concept. Similarly, the drive mechanism requires only one end gear 42 to function adequately although the balanced drive illustrated is preferred.

Figure 10:
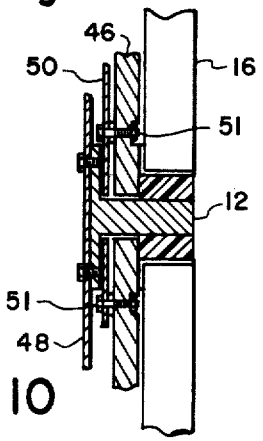
FIG. 10 is a fragmentary sectional view of the connecting means between the end gears and the lever arms.

At each end of the barrel, sandwiched between the barrel end 48 and the gear 46 is a generally rectangular-shaped lever arm 50 which is mounted to pivot about the hub 12 and coaxially with the barrel. Each lever arm 50 is mechanically connected to the end gear 46 by bolt means 51 best illustrated in FIG. 10. The purpose is to have a rigid connection between the two as the structure described is designed to have the lever arm 50 transmit force from the end gears 46 to a door 52 which swings through an arc between open and closed positions best illustrated in FIGS. 5 and 6.

It should be noted that while the apparatus is illustrated as rotating in a clockwise direction in all embodiments herein, it is clear that rotation in a counter clockwise direction to close the door would be equally effective and no implication should be drawn from the illustrated direction of rotation nor the specific location of the door opening 54.

Figure 5:
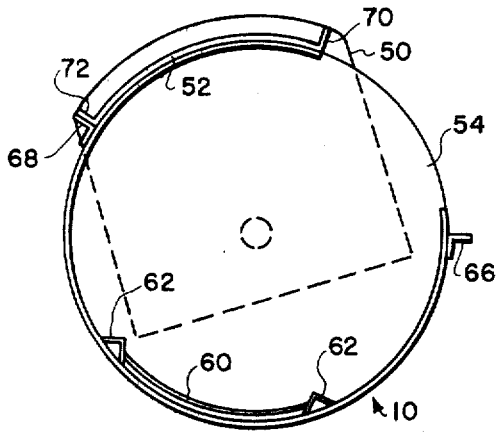
FIG. 5 is a diagrammatic view of the barrel as it rotates in counter clockwise direction or in stopped position with the door in open position to allow the filling of the barrel with particulate matter.
Figure 9:
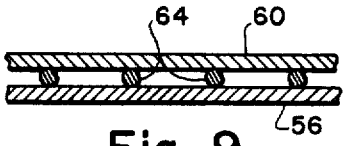
FIG. 9 is a fragmentary sectional view taken along line 9—9 of FIG. 4.

The barrel includes an opening 54 through its sidewall 56 and when the door is in open position, as illustrated in FIG. 5, particulate material may be dumped through the opening 54 to partially fill the barrel. In practice, the barrel is loaded with the opening 54 inclined from the vertical and in this manner, particulate material may be dumped into the barrel without striking the framework 14. As is often the case, continuned loading and unloading of the barrel involving heavy pieces of metal tends to distort and abrade the side of the barrel immediately below and slightly forward of the opening. For this reason, the inventor has provided an impact plate 60 spanning about 80° in an arc measured from the axis of rotation of the barrel. Thus, particulate material dumped through opening 54 will impinge on plate 60 which is mounted between tumbling fins 62 and is spaced radially inwardly from the surface of the barrel. In this manner, the impact plate may be replaced periodically without having to replace the whole barrel. To further assist in absorbing these impacts and minimizing damage to the barrel itself, annularly extending rods 64 are provided between the surface of the barrel 56 and the impact plate 60, see FIG. 9.

Because of the desire to locate the impact plate 60 such that it will receive the impact of most of the particulate matter falling into the barrel through the opening 54, it is located whereby the plate extends for about 80° measured from the axis of rotation of the barrel with the edge of the plate nearest the opening 54 being about 100° from the centerline of the opening. More specifically, it is desirable that the centerline of the plate 60 be angularly displaced from the centerline of the opening 54 by about 145°–155°. This is deemed to be the best location for receiving most of the impact in the desired manner.

Welded longitudinally along the periphery of the barrel are two L-shaped channels 66 and 68 which serve as stop means for the door 52 in its rotation relative to the barrel. Any rotation of the door subsequent to its engagement with either of the stop means 66, 68 results in rotation of the barrel and its contents in the same direction, the door itself serving as the driving mechanism for the barrel.

Having thus described the elements of the invention, its use will now be described in operation.

Figure 6:
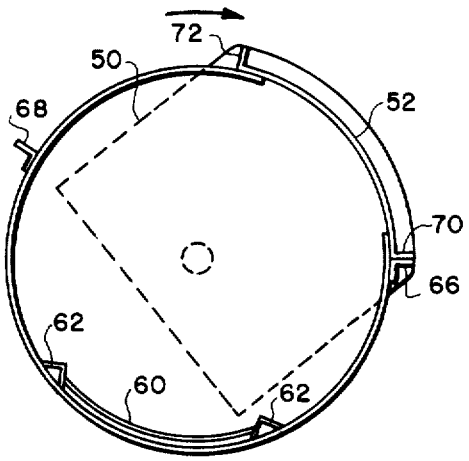
FIG. 6 shows the barrel with the door rotated to its closed position and just as it begins to drive the barrel in its rotation.
Figure 7:
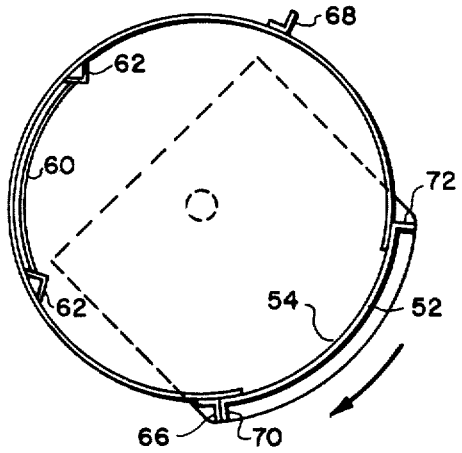
FIGS. 7 and 8 illustrate the position of the door and barrel in its sequential turning from FIG. 6.
Figure 8:
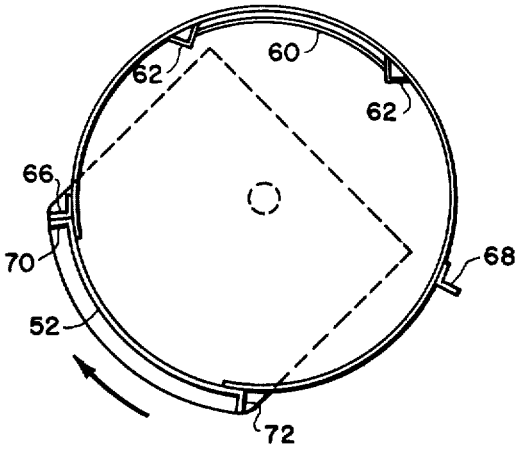

Initially the door 52 is rotated such that the opening 54 is unobstructed and particulate material is dumped therein. After the drum is filled to the desired capacity, the motor 28 is actuated and through the power chain of gear reducer 30, sprocket 32, chain 34, sprocket 36, shaft 38, drive gear 42, idler gear 44, end gear 46, lever arm 50 and door 52, the door is driven to closed position as illustrated in FIG. 6 from open position illustrated in FIG. 5. As the door rotates, its forward or leading edge comprising an L-shaped channel or lip 70 will engage stop means 66 and the barrel will begin to turn. Then while stopped or while still turning, the barrel may be lifted with its frame and lowered into a tank of treating fluid where it will continue to rotate until such time as the desired treatment has been completed. At which time the barrel will be lifted from the tank and placed in another tank and/or subsequently to a place where the particulate material has been adequately treated and is to be dumped for further processing or packaging or whatever mechanism is desired to get it to a market place.

When the drum is conveyed to a dump area and set down on a substrate where it will be supported by the legs 16, the direction of the motor 28 and the other elements in the drive train will be reversed which will drive the door in a counter clock-wise direction to its open position as illustrated in FIG. 5 until the opposite door edge 72 engages the other stop means 68 and at that time the barrel will begin to rotate in a counter-clockwise direction until the opening 54 is facing downward and the particulate material will fall out of the barrel by gravity.

It has been suggested that lock means may be provided as a safety factor to lock the door in either open or closed positions and such is not beyond the spirit of this invention but none are shown as they are not deemed to be necessary for a full understanding of this invention.

One might wonder at the possibility of the particulate material falling out of the drum prematurely as the direction of rotation of the drum is changed but, such an event is physically impossible. By way of example in FIG. 6, when the barrel is rotating clockwise the particulate material will be pushed up the left-hand side of the barrel. It will not lie in the bottom of the barrel because the particulate material will only tumble when its angle of repose is exceeded as the barrel continues to turn. Conversely, when the direction of rotation of the end gear 46 is changed by reversal of the motor 28, the door and lever arm will begin to rotate in a counter-clockwise direction, Due to gravity, the particulate matter will turn the barrel counter-clockwise while maintaining the abutting L-shaped stop means 66 and 70 in contact until the particulate matter is located in the bottom of the barrel. Then the barrel will stop rotating while the door and lever arms continue to rotate until the L-shaped edge 72 engages the stop means 68, at which time the barrel will again begin to rotate due to the force exerted by the door driven by the end gear. Then the particulate matter will ride up on the right-hand side of the drum for the same reason as it was riding up the left-hand side when the rotation was in the opposite direction. It will slowly tumble, due to the force of gravity until the opening 54 is near the bottom and then it will be dumped out onto the substrate supporting the frame or perhaps into a basket or other catching means suitably disposed beneath the opening. The barrel is then ready for transport to the filling site to begin the cycle again.

Figure 11:
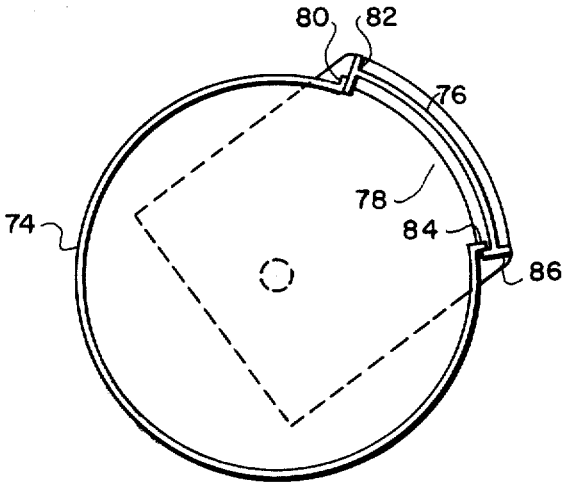
FIG. 11 is a fragmentary sectional view of the barrel of this invention showing a modification of the door and the opening into the barrel.

FIG. 11 illustrates a modified opening and closing structure at the opening edges and the door edges. The barrel 74 is shown in closed position with the door 76 blocking the opening 78. An outwardly extending abutment or flange 80 on the left-hand side of the opening 78 is in abutment with a T-shaped abutting end 82 on the forward or driving end of the door 76. Note that the radially extending surfaces of the abutments 80 and 82 form a line contact to prevent small parts from falling through the opening or becoming lodged between the door and the periphery of the barrel 74. Similar sealing contact is made between the outwardly extending flange or abutment 84 on the right-hand side of the barrel opening and the mating T-shaped abutment 86 on the right-hand side of the door 76. As will be clear, rather close tolerances will be required in this particular structure, but the two sealing surfaces will serve the very valuable function of preventing small parts in the barrel from falling out or becoming wedged between the exterior barrel surface and the interior door surface. Clockwise rotation brings flanges 82 and 84 into contact to dump the tumbling load as in the previous embodiment.

Figure 12:
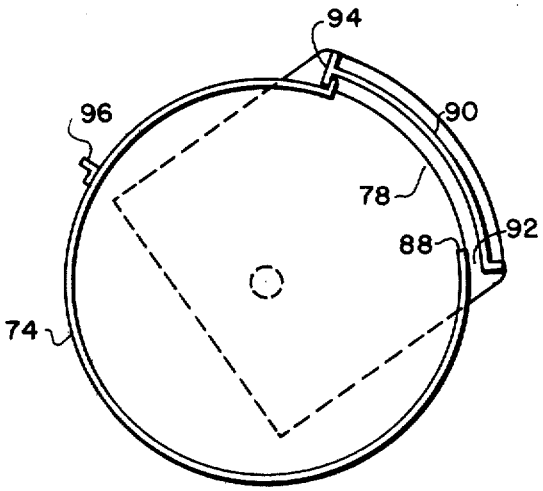
FIG. 12 is a fragmentary sectional view similar to FIG. 11 showing another alternative structure for the barrel door and barrel opening.

FIG. 12 is another modification of the barrel 74 of FIG. 11. In this case the opening 78 has no flange at the right-hand edge 88 of the opening 78. In the illustration with the door 90 in closed position the barrel will be rotating clockwise and particles within the barrel tumbling will ride up over the edge 88 as it starts upward from its bottom section and will fall onto the inner surface of the door 90 and due to the direction of tumble could not possibly pass into the small space 92 between the door and the barrel surface, because gravity would carry the particle in the other direction.

Driving the barrel in the clockwise direction is accomplished by the downwardly extending portion of the T-shaped abutment 94 on the left-hand side of the door 90. It will be clear from the previous explanations that when the direction of rotation is reversed the T-shaped abutment 94 will rotate to contact with radially extending flange 96 and together they will serve to rotate the barrel in a counter-clockwise direction to allow the particles within the barrel to be dumped through opening 78.

Having thus described the invention, it will be obvious to those having ordinary skill in the art that certain modifications may be made in the apparatus without departing from the spirit or scope of the invention. It is not the inventor's intention to be bound by the limited description herein nor the language used to describe the apparatus, rather it is intended that the inventor be limited only by the scope of the appended claims.

I claim:

1. A rotatable barrel for use in the surface treatment of particulate matter enclosed therein, said barrel having ends and side structure, said ends being mechanically attached to means forming the side structure, said side structure means being foraminous, an opening means in said foraminous side structure means for the insertion and discharge of particulate matter, said barrel being rotatable about an axis extending perpendicular to the ends of said barrel, a door for opening and closing said opening means, said door being mounted on lever arms, one said lever arm being spaced from each end of the barrel and extending radially from its axis of rotation, a hub means on each end of the barrel extending coaxially with said axis of rotation, said lever arms being mechanically attached to the hub means to thereby swing the door in an arc having an axis coaxial with said hub means, stop means for limiting the angle of said arc in which said door may swing relative to the barrel, at least one of said lever arms being mechanically attached to a gear mounted on one side of said hub means whereby, rotation of said gear in one direction drives the door to closed abutting position against one of said stop means and the barrel is thereafter rotated by force exerted by (1) the gear, (2) the attached lever arm and (3) the door pushing against the stop means, the stop means in abutment with the door comprising an L-shaped channel member welded to the periphery of said barrel adjacent one edge of the opening means and extending from one end to the other, the portion of the door abutting the stop means comprising a radially inwardly extending flange whereby the abutting flange and stop means serve to seal one edge of the opening against loss of the particulate matter during tumbling.

2. The barrel of claim 1 wherein a gear is affixed to the hub means and each lever arm to balance the barrel driving force and increase the life of the same.

3. The barrel of claim 1 wherein rotation of the gear in the opposite direction drives the door to open position against the other stop means and thereafter the barrel rotates due to the force exerted by (1) the gear, (2) the attached lever arm and (3) the door and particulate matter is dumped from the barrel as the opening rotates to the barrel down side.

4. The barrel of claim 3 wherein the portion of the door abutting the other stop means comprises opposite surface the same radially inwardly extending flange.

5. The barrel of claim 1 being mounted within a frame having leg portions for supporting said barrel above a substrate, said frame supporting said barrel by said hub means.

6. The barrel of claim 5 wherein the hub mounted gear is caused to rotate by an idler gear which, in turn, is driven by a gear, said drive gear being actuated by a motor mounted on said frame above said barrel.

7. The barrel of claim 6 including a splash plate mounted on said frame above the motor to prevent liquids dropping from above from contacting said motor.

8. The barrel of claim 1 including an impact plate within said barrel for absorbing the shock of particulate matter dumped into said barrel through said opening means.

9. The barrel of claim 8 wherein the center of the impact plate is separated from the center of the opening means by an angle in the range 145°–155°, measured at the axis of rotation of the barrel.

10. The barrel of claim 1 wherein the only active force of rotation exerted against the barrel is by the door.

11. A rotatable barrel for use in the surface treatment of particulate matter enclosed therein, said barrel having ends and side structure, said ends being mechanically attached to means forming the side structure, said side structure means being foraminous, and opening means in said foraminous side structure means for the insertion and discharge of particulate matter, said barrel being rotatable about an axis extending perpendicular to the ends of said barrel, a door for opening and closing said opening means, said door being mounted on lever arms, one said lever arm being spaced from each end of the barrel and extending radially from its axis of rotation, a hub means on each end of the barrel extending coaxially with said axis of rotation, said lever arms being mechanically attached to the hub means to thereby swing the door in an arc having an axis coaxial with said hub means, stop means for limiting the angle of said arc in which said door may swing relative to the barrel, the barrel being mounted within a frame having leg portions for supporting said barrel above a substrate, said frame supporting said barrel by said hub means, a gear being mounted on said hub means and being in driving engagement with an idler gear which, in turn, is in driving engagement with a drive gear, said drive gear being mounted in operative position to be driven by a motor mounted on said frame above the barrel, and splash plate means mounted above the motor for preventing fluids dropping from above from contacting the motor.

* * * * *

UNITED STATES PATENT AND TRADEMARK OFFICE

Certificate

Patent No. 3,944,189 Patented March 16, 1976

Albert Singleton

Application having been made by Albert Singleton, the inventor named in the patent above identified, for the issuance of a certificate under the provisions of Title 35, Section 256, of the United States Code, adding the name of Carel Henry Neffenger as a joint inventor, and a showing and proof of facts satisfying the requirements of the said section having been submitted, it is this 22nd day of March 1977, certified that the name of the said Carel Henry Neffenger is hereby added to the said patent as a joint inventor with the said Albert Singleton.

FRED W. SHERLING,
*Associate Solicitor.*